US007338319B2

(12) United States Patent
Casses et al.

(10) Patent No.: US 7,338,319 B2
(45) Date of Patent: Mar. 4, 2008

(54) SEALING SYSTEM FOR MULTITERMINAL ELECTRICAL CONNECTOR

(75) Inventors: Claude Casses, Clevilliers (FR); Gérard Mulot, Nogent le Roi (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/527,341

(22) PCT Filed: Aug. 26, 2003

(86) PCT No.: PCT/FR03/50038

§ 371 (c)(1),
(2), (4) Date: Oct. 31, 2005

(87) PCT Pub. No.: WO2004/025787

PCT Pub. Date: Mar. 25, 2004

(65) Prior Publication Data

US 2006/0128234 A1 Jun. 15, 2006

(30) Foreign Application Priority Data

Sep. 12, 2002 (FR) ..... 02 11342

(51) Int. Cl.
*H01R 13/40* (2006.01)

(52) U.S. Cl. ..... 439/587; 439/274

(58) Field of Classification Search ..... 439/587, 439/274, 275, 589, 271
See application file for complete search history.

(56) References Cited

U.S. PATENT DOCUMENTS

| | | | | |
|---|---|---|---|---|
| 5,611,706 | A * | 3/1997 | Makita et al. | 439/275 |
| 5,931,699 | A * | 8/1999 | Saito | 439/587 |
| 6,058,977 | A | 5/2000 | Hotta | 138/89 |
| 6,257,928 | B1 * | 7/2001 | Murakami et al. | 439/587 |
| 6,431,912 | B1 * | 8/2002 | Mori | 439/587 |
| 6,638,108 | B2 * | 10/2003 | Tachi | 439/595 |
| 6,672,900 | B2 * | 1/2004 | France et al. | 439/587 |
| 7,029,328 | B1 * | 4/2006 | Mckenzie et al. | 439/587 |
| 2002/0127912 | A1 * | 9/2002 | Hamai et al. | 439/587 |

FOREIGN PATENT DOCUMENTS

| | | |
|---|---|---|
| EP | 0 964 482 A1 | 12/1999 |
| EP | 1 041 678 A1 | 10/2000 |
| EP | 1 204 174 A1 | 5/2002 |

* cited by examiner

*Primary Examiner*—Hien Vu
(74) *Attorney, Agent, or Firm*—Harrington & Smith, PC

(57) ABSTRACT

The invention concerns a sealing system for a multiterminal electrical connector (1) comprising a multiterminal seal (10) with several through-holes (11) passing right through the seal and each one designed to receive an electrical connection wire (5) and a tubular single-unit seal (20) partly enclosing the connection wire and inserted, at least partly, in one of the through-holes of the multiterminal seal.

12 Claims, 3 Drawing Sheets

SEALING SYSTEM FOR MULTITERMINAL ELECTRICAL CONNECTOR

FIELD OF THE INVENTION

The invention concerns a sealing system for an electrical connector, and more particularly, for a multiterminal type electrical connector. This sealing system is designed, in particular, to guarantee sealing of the connector around the electrical connection wires at the rear of the connector, i.e., in a zone of the connector where the electrical wires are not introduced into the connection terminals.

The invention is applied in the field of electrical or electronic connector technology and, in particular, in the connector field intended for the automobile industry.

STATE OF THE ART

Currently, multiterminal electrical connectors are used in numerous technical fields. These multiterminal connectors are designed so as to receive several connection terminals, male or female, in each of which is crimped an electrical connection wire. In a general way, multiterminal electrical connectors comprise a plastic body having several chambers, each designed to receive a connection terminal. Inside the plastic body is housed a grommet-type seal, through which pass several connection wires, each of which terminate in one of the different connection terminals. This grommet-type seal, simply called a grommet, is generally provided with channels or through-holes into which the connection wires are introduced. Generally, there is a grommet through-hole in the extension of each chamber of the plastic body of the connector, this through-hole being situated at the rear of the connector.

The role of the grommet is to assure the tight seal of the connector, preventing moisture or dust from being introduced into the connector through the rear of the connector.

Usually, each connection terminal crimped around a connection wire is inserted into a chamber of the plastic body and the connection wire is inserted into the grommet through-hole. Thus, the connection terminals are housed in the front part of the connector and the electrical wires in the rear part of the connector. However, the terminals are introduced into the front part of the connector from the rear of the connector. In other words, the connection terminals must pass through the grommet through-holes in order to reach their chambers. Now, the terminals often have a square section rather than a round section like the electrical wires. In addition, when the grommet through-holes have a round section, it is difficult to pass the terminals through the through-holes. In contrast, if the grommet through-holes have a square section, then the seal at the level of the electrical wires is no longer assured by the grommet.

In order to resolve this problem, there are several sealing devices adapted for grommets to assure the seal of the connector from the rear of the connector, i.e., at the level of the electrical wires, so as to prevent any penetration of moisture or dust.

One of these rear sealing devices is described in Patent Application EP-A-0 625 807. This sealing device concerns a connector 1 provided with a grommet 2 made of an elastic material and provided with through-holes 3, or through-holes, permitting the passage of terminals 4 and connection wires 5. Through-holes 3 are provided with lips 6 permitting the passage of terminals equipped with their connection wires and being enclosed on these wires, when the terminals are passed through, so as to assure a seal at the level of the wires. This device has two types of lips: peripheral lips that assure a peripheral seal against the walls of the rear part of the connector and inner lips that assure the seal near the connection terminals.

Such a device correctly assures the seal of the connector at the level where the connection wires pass through, when the connection wire section is of the same order of magnitude as the section of the connection terminals. In contrast, when the section of the connection wires is notably smaller than the section of the connection terminals and, more precisely, when it is not of the same order of magnitude as the section of the connection terminals, then the passage of said connection terminals damages the lips of the grommet through-holes, which, after the passage of these terminals, can no longer sufficiently crimp the connection wires to guarantee a sufficient seal. This is particularly the case when the ratio between the section of a connection terminal and the section of the connection wire is greater than 2. In fact, it is understood that the passage of connection terminals of a diameter larger than that of the connection wires stretches the lips of the grommet through-holes, as a consequence of which the lips can no longer sufficiently crimp the connection wires to prevent the penetration of moisture or dust.

For example, in certain applications, connection through-holes have a width of 2.8 mm and connection wires have a section of 0.22 $mm^2$. In this case, it is not possible to obtain a seal around the electrical wires by the device described above.

DISCLOSURE OF THE INVENTION

The object of the invention is to remedy the disadvantages of the techniques described previously. For this purpose, the invention proposes a sealing system for a multiterminal electrical connector comprising, on one hand, a multiterminal seal of the grommet type, and on the other hand, a single-unit seal placed around the connection wire and housed inside the multiterminal seal, when the connection wire has a section that is not of the same order of magnitude as the section of the connection terminal.

More precisely, the invention concerns a sealing system for an electrical connector comprising a multiterminal seal with several through-holes passing right through the seal and designed to receive an electrical connection wire, characterized in that it also comprises at least one single-unit seal of a tubular shape, partly surrounding the connection wire and at least partially inserted into one of the multiterminal seal through-holes.

Advantageously, the single-unit seal comprises sealing lips on at least a part of its length, and these sealing lips press against the multiterminal seal through-hole; the through-hole has sealing lips on at least part of its length, and these sealing lips press against the connection wire.

DETAILED DESCRIPTION OF THE EMBODIMENTS OF THE INVENTION

Figure 1:
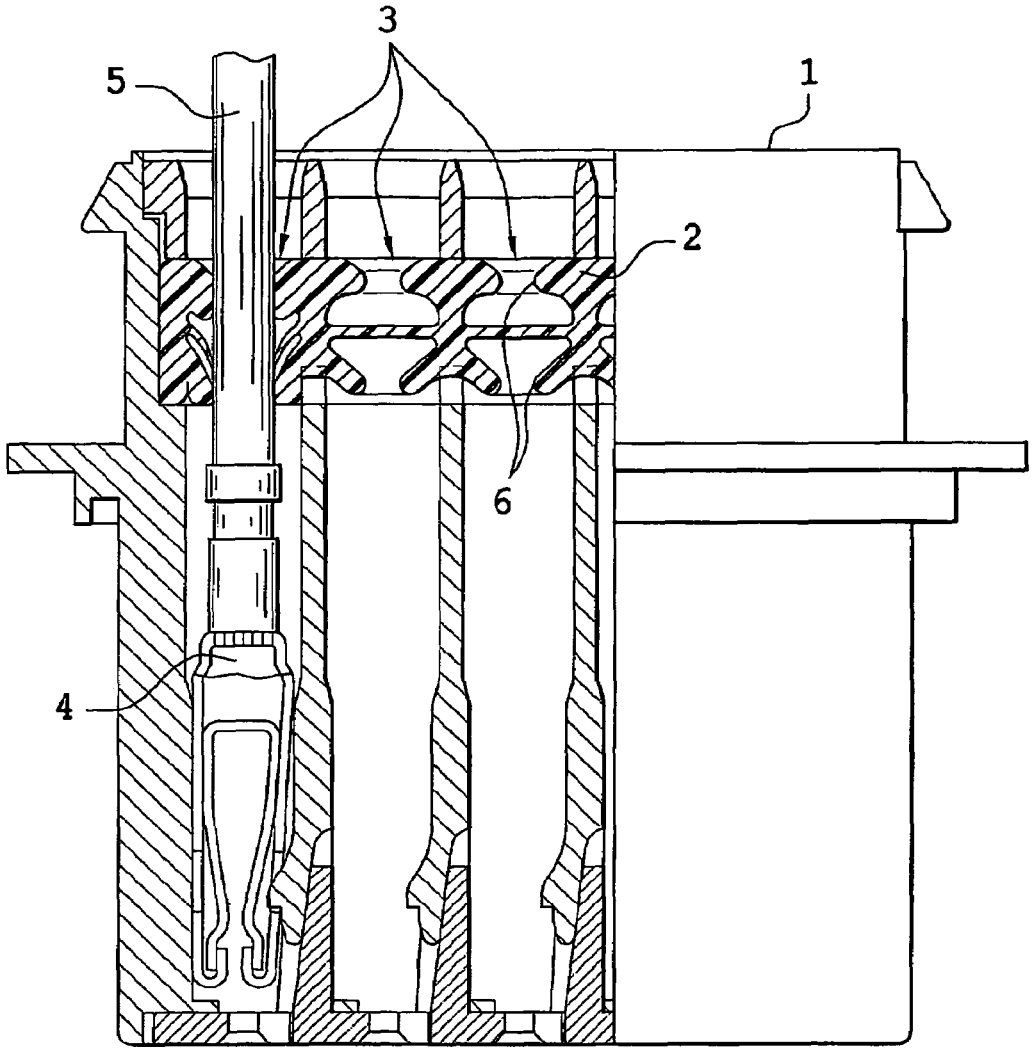
FIG. 1, already described, shows a rear sealing device for a multiterminal electrical connector according to the prior art.
Figure 2:
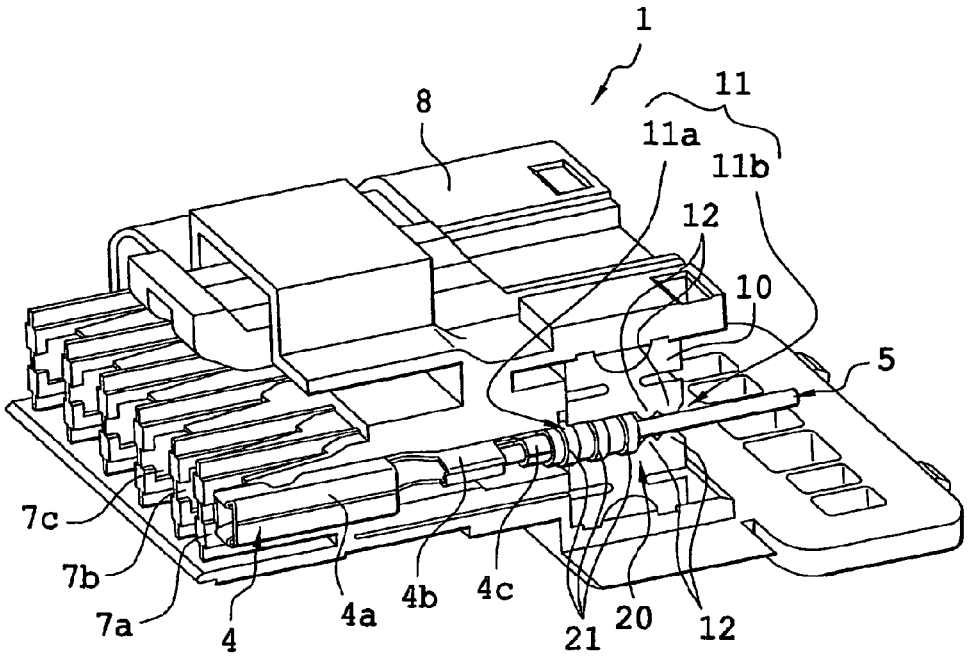
FIG. 2 shows the sealing system for a multiterminal electrical connector according to to the invention, in the case where the connection wire is of small section.

A multiterminal electrical connector provided with the sealing system of the invention is shown in FIG. 2. This electrical connector 1 has a plastic body 8 itself comprising several chambers 7*a*, 7*b*, 7*c*, etc., each of which is designed to receive a connection terminal 4 into which a connection wire 5 is crimped. In this FIG. 2, connection terminal 4 is a female terminal comprising

- a front part 4*a* in which a complementary male connection terminal is encased,
- a rear part 4*c* surrounding the insulation of the connection wire and assuring its role of receiving the wire, and
- a transition part 4*b* in which the stripped part of the connection wire is crimped.

Each chamber 7*a*, 7*b*, 7*c*, etc. can receive a connection terminal similar to terminal 4 or even a different connection terminal such as, for example, a male connection terminal. These connection terminals are each crimped around an electrical connection wire that can have a section of small diameter, of an order of magnitude smaller than the section of the connection terminal, as is the case for the connection wire 5 crimped in connection terminal 4. As can be seen in the following, these connection terminals can also each be crimped around a connection wire having a section of the same order of magnitude as the section of the connection terminal.

According to the invention, the sealing system of connector 1 comprises, on the one hand, a multiterminal seal 10 of the grommet type, also called a grommet, and on the other hand, one or more single-unit seals 20. Multiterminal seal 10 comprises several through-holes 11, through each of which passes a connection wire 5. More precisely, multiterminal seal 10 has a through-hole placed at the rear of the connector, at the end of each chamber 7*a*, 7*b*, 7*c*, etc. of the connector. Thus, the connection wire that terminates in the connection terminal housed in the chamber situated in the extension of each through-hole passes through the through-hole considered.

Single-unit seal 20, of tubular shape, surrounds connection wire 5, on a part of its length, in the case where the connection wire is of a small section. Single-unit seal 20, made of a flexible material, is inserted into a through-hole of multiterminal seal 10. Of course, the sealing system of the invention comprises as many single-unit seals as there are electrical wires having a small section relative to the section of the connection terminal in which it is crimped.

Each through-hole 11 of multiterminal seal 10 comprises two parts, i.e., a front part 11*a* and a rear part 11*b*. Front part 11*a* is the part closest to the connection terminal; it has a smooth section Sa. Rear part 11*b* is the part closest to the rear of the connector; it has a section Sb. Front part 11*a* is designed to receive single-unit seal 20. Rear part 11*b* is designed to receive connection wire 5. The two sections Sa and Sb therefore preferably have different dimensions adapted to the section of the element that they receive.

Rear section Sb comprises outer sealing lips 12. These sealing lips 12 are designed to press against electrical connection wire 5 so as to prevent the penetration of moisture or dust into the connector, along this wire 5.

Moreover, single-unit seal 20 comprises inner sealing lips 21 designed to press against the smooth section Sa of the front part of through-hole 11. In other words, these sealing lips 21 assure the seal in the multiterminal seal, at the level of the single-unit seal.

Single-unit seal 20 can also comprise a smooth section, not visible in this figure since it is inserted in the rear part 4*c* of connection terminal 4. In fact, single-unit seal 20 surrounds connection wire 5 on its part closest to the connection terminal. It can also surround wire 5 in the zone that is introduced into rear part 4*c* of connection terminal 4.

In this way, the receiving of wire 5 by the connection terminal is made rigid, which permits facilitating the introduction of the terminal into connector 1. Of course, the single-unit seal surrounds the connection wire in a zone where the connection wire is not stripped.

As can be understood from reading the preceding, the seal in connector 1 is assured by the pressure of outer lips 12 of multiterminal seal 10 on connection wire 5 and/or by the pressure of inner lips 21 of single-unit seal 20 on the walls of through-hole 11 of multiterminal seal 10. Thus, if the passage of terminal 4 through through-hole 11 damages outer lips 12 of said through-hole, preventing the lips from pressing correctly against wire 5, the inner lips 20 of single-unit seal 20 will assure the seal of the connector.

Figure 3:
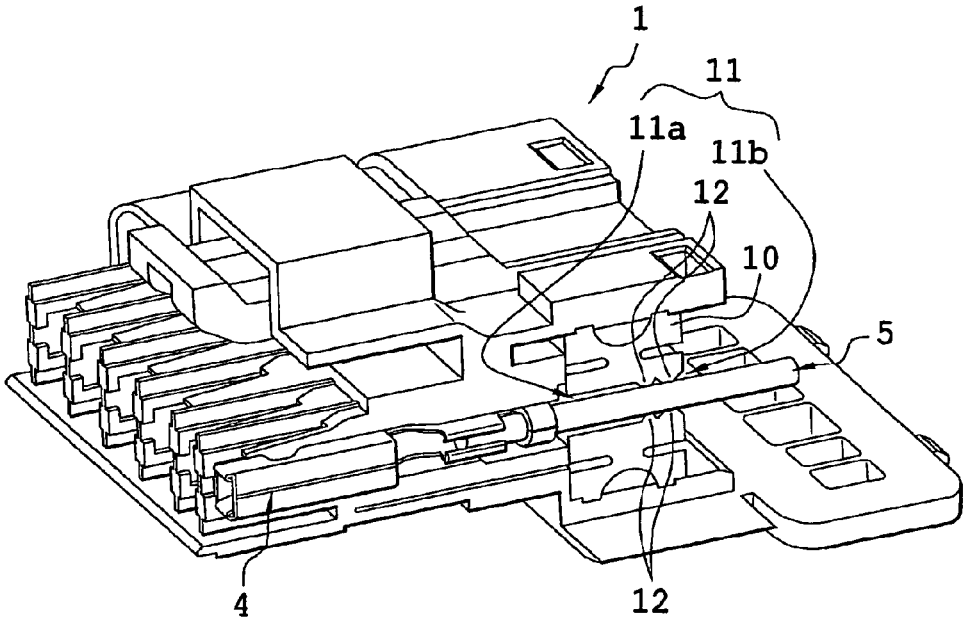
FIG. 3 shows the sealing system for a multiterminal electrical connector according to the invention, in the case where the connection wire has a section of the same order of magnitude as the section of the connection terminal.

In FIG. 3, the same electrical connector as in FIG. 2 is shown, but in the case where connection wire 5 has a larger section than that of FIG. 2, i.e., a section of the same order of magnitude as the section of connection terminal 4. For example, in the case of FIG. 2, connection wire 5 has a section of less than 1 $mm^2$, while in the case FIG. 3, it has a section larger than 1 $mm^2$.

In this case, since connection wire 5 has a section of the same order of magnitude as the section of connection terminal 4, it is not useful to use a single-unit seal 20. In fact, since wire 5 has a section that is close to that of connection terminal 4, the passage of the terminal into through-hole 11 does not risk destroying the quality of the pressure of outer lips 12 on wire 5. Outer lips 12 therefore well assure the seal of the connector.

Thus, it is understood that, in the case where the connection wire has a section close to that of the connection terminal, it is the multiterminal seal that assures the seal of the connector due to the existence of its sealing lips 12. In contrast, when the connection wire has a section smaller than that of the connection terminal, it is single-unit seal 20 surrounding the connection wire that assures the seal of the connector by means of its sealing lips 21.

Figure 4:
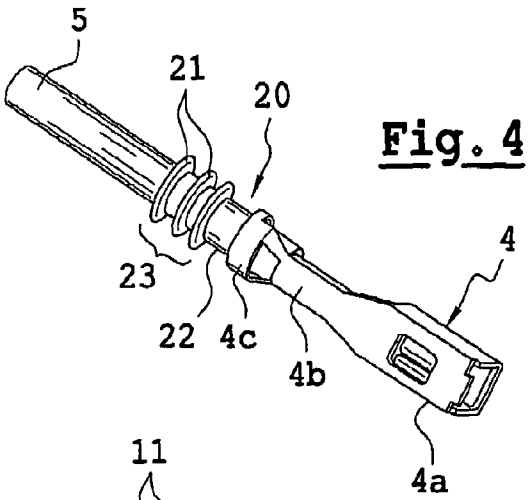
FIG. 4 shows a single-unit seal of the sealing system of the invention.

FIG. 4 shows single-unit seal 20 surrounding a connection wire 5 and introduced into a connection terminal 4. In this figure, the connection terminal is shown viewed from the back, thus showing its rear part 4*c* that is used to receive single-unit seal 20. This figure also shows the smooth section 22 of single-unit seal 20, i.e. the section that does not have any sealing lip. This section 22 can be introduced into terminal 4 or even can simply abut against the receiving part 4*c* of the terminal.

Rear section 23 of single-unit seal 20 has inner sealing lips 21, for example, three in number. Section 22 of the single-unit seal can have a dimension greater than that of section 23, excluding the sealing lips.

Such a single-unit seal 20 has the advantage of increasing the section of connection wire 5 when the latter is reduced in size. A pressure between the multiterminal seal and the connection wire can thus take place, by means of the single-unit seal that then assures the seal in the connector.

Figure 5:
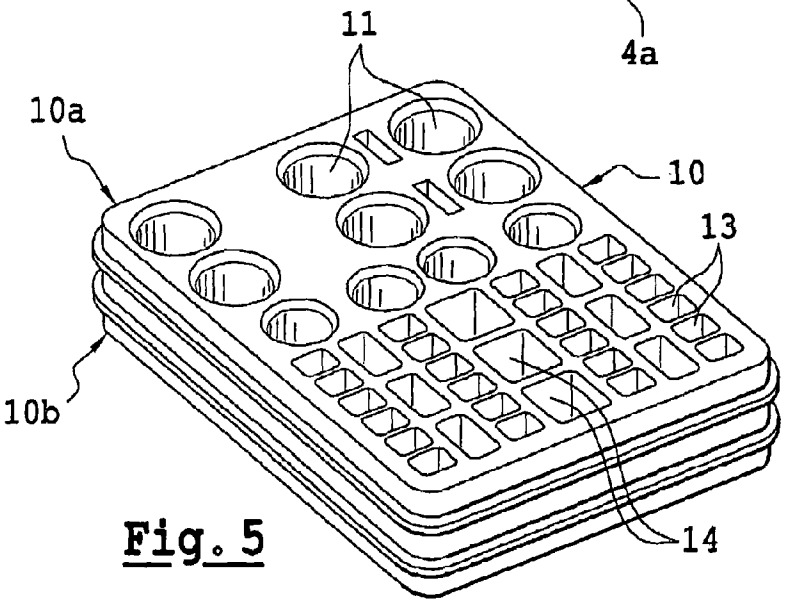
FIG. 5 shows a multiterminal seal of the sealing system of the invention.

An example of a multiterminal seal that can be used in the sealing system of the invention is shown in FIG. 5. This multiterminal seal 10, or grommet, is made of an elastic and impermeable material. It comprises a plurality of through-holes that can have different shapes and several dimensions. The through-holes can have a round section like through-hole 11 described previously or even a square section, such as through-holes 13 and 14. The shapes and dimensions of the through-holes depend on the types of terminals and wires used for the connections to be made. The multiterminal seal of the invention can be made of two plates 10*a* and 10*b* positioned on top of one another in such a way that their through-holes are in concordance. Thus, in one plate the front parts of the through-holes can be provided, which are of smooth section, and in the other plate, the rear parts of the through-holes, whose sections are provided with sealing lips that can be created. The two plates can be attached to one another by different attachment means, for example, glue.

Figure 6:
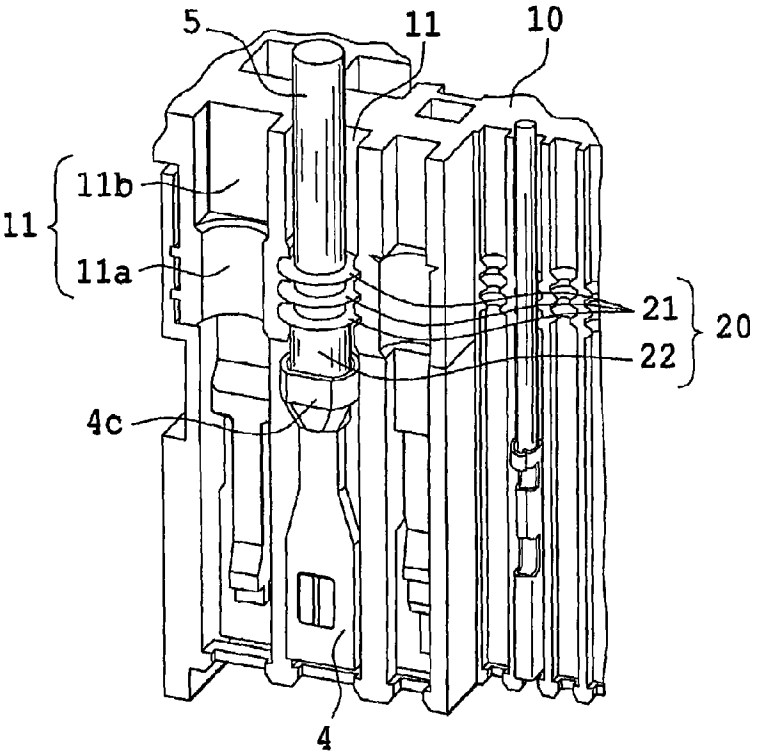
FIG. 6 shows a sectional view of a sealing system according to the invention.

FIG. 6 shows a top view in section of a through-hole comprising the sealing system of the invention. This FIG. 6 shows through-hole 11 of multiterminal seal 10 in section, with connection wire 5 surrounded by single-unit seal 20 inside. Smooth section 22 of the single-unit seal is inserted into receiving part 4*c* of terminal 4 and the section with lips 21 is housed in front part 11*a* of through-hole 11. In this FIG. 6 it can be seen that smooth section 22 of the single-unit seal is not in contact with the walls of through-hole 11. This section 22 has the sole role of facilitating the insertion and maintenance of connection wire 5 in connection terminal 4. In contrast, lips 21 of single-unit seal 20 have a section larger than the section of through-hole 11 of the multiterminal seal, which explains lips 21 being permanently pressed against the walls of the through-hole, thus assuring the seal in the connector.

In the embodiment shown in FIG. 6, rear part 11*b* of through-hole 11 does not have sealing lips. In this embodiment, only a connection wire of small section, surrounded by a single-unit seal 20 can be housed in through-hole 11.

In contrast, in the embodiments of FIGS. 2 and 3, either a connection wire of small section and provided with a single-unit seal, or a connection wire of larger section without a single-unit seal can be introduced into through-hole 11.

The invention claimed is:

1. A multi-terminal electrical connector sealing system comprising:

a plastic body for use with an electrical connector in which is housed:

a multi-terminal seal, wherein the multi-terminal seal comprises a flexible material having a plurality of through-holes that pass completely through the multi-terminal seal, wherein at least one of the through-holes is sized and shaped to receive an electric connection wire, wherein a rear part of the at least one through-hole has sealing lips sized and shaped to press on the connection wire, wherein the plastic body is sized and shaped to at least partially house an electrical terminal connected to the wire; and at least one single-unit seal having a general tubular shape, wherein the single-unit seal is sized and shaped to surround a portion of the connection wire, and wherein the single-unit seal is sized and shaped to be located at least partially in one of the through-holes of the multi-terminal seal, wherein the at least one through-hole of the multi-terminal seal has a front part having a section which is sized and shaped to at least partially receive the single-unit seal.

2. The sealing system according to claim 1, further characterized in that the single-unit seal has a first section provided with sealing lips pressing on the walls of the through-hole.

3. The sealing system according to claim 1, further characterized in that the single-unit seal has a smooth second section.

4. The sealing system according to claim 3, further characterized in that the second section of the single-unit seal is adapted to be partially inserted into the connection terminal.

5. The sealing system according to claim 1, further characterized in that the through-holes of the multi-terminal seal each have a rear part having a section which is adapted to at least partially conform to a larger size connection wire which can be used with the electrical connector without the single-unit seal.

6. The sealing system according to claim 5, further characterized in that front part of the through-holes is smooth.

7. The sealing system according to claim 1, further characterized in that the multi-terminal seal comprises two plates positioned on top of one another, one of these plates comprising the front part of the through-holes and the other plate comprising the rear part of the through-holes.

8. The sealing system according to claim 1, further characterized in that the multi-terminal seal is of an elastic and impermeable material.

9. An electrical connector comprising several connection terminals and electrical connection wires, wherein the electrical connector comprises the sealing system according to claim 1.

10. An electrical connector comprising:

a housing;

at least one electrical terminal connected to the housing;

a multi-terminal seal in the housing having a plurality of through-holes receiving electrical wires having electrical terminals thereon; and at least one single-unit seal having a general tubular shape, wherein the single-unit seal at least partially surrounds one of the connection wires, wherein the single-unit seal is located partially in one of the through-holes of the multi-terminal seal, and wherein the through-holes of the multi-terminal seal each have a front part having a section which partially receives the single-unit seal, wherein a rear part of the through-holes each has sealing lips pressing on the connection wire.

11. An electrical connector subassembly comprising:

a housing having electrical terminal receiving areas; and a multi-terminal seal connected to the housing, wherein the multi-terminal seal comprises a plurality of through-holes receiving electrical wires having electrical terminals connected thereto, wherein the through-holes each comprise a front section and a rear section, wherein the rear sections each partially receive a first one of the electrical wires having a first larger size, wherein the rear parts of the through-holes each has sealing lips pressing on the wire, wherein the front sections each receive a single-unit seal having a tubular shape which are inserted into the front section for sealing with a second electrical wire having a second smaller size, and wherein the front sections each partially receive a single-unit seal.

12. An electrical connector subassembly as in claim 11 further comprising at least one single-unit seal located in at least one of the front sections of the multi-terminal seal.

* * * * *